US005947137A

United States Patent [19]

Sheafer

[11] Patent Number: 5,947,137

[45] Date of Patent: Sep. 7, 1999

[54] DRAW-TUBE SOLVENT RETAINING AND DRAINING COVER

[76] Inventor: Tim Sheafer, 112 Hunter, Sibley, Mo. 64088

[21] Appl. No.: 09/195,304

[22] Filed: Nov. 18, 1998

[51] Int. Cl.[6] ..... B08B 3/08

[52] U.S. Cl. ..... 134/117; 134/170; 134/166 C; 134/201

[58] Field of Search ..... 134/170, 114, 134/117, 166 R, 166 C, 201; 118/302; 239/104, 120, 110

[56] References Cited

U.S. PATENT DOCUMENTS

| | | | |
|---|---|---|---|
| 2,786,000 | 3/1957 | Roach | 134/21 |
| 4,380,478 | 4/1983 | Cooney | 134/38 |
| 4,693,423 | 9/1987 | Roe | 239/332 |
| 4,791,946 | 12/1988 | Cavanaugh | 134/99 |
| 4,793,369 | 12/1988 | Robb et al. | 134/170 |
| 4,957,127 | 9/1990 | Kostopoulos | 134/117 |
| 5,025,818 | 6/1991 | Kalar | 134/170 |
| 5,174,317 | 12/1992 | Robb et al. | 134/166 C |
| 5,183,066 | 2/1993 | Hethcoat | 134/54 |
| 5,226,599 | 7/1993 | Lindermeir | 239/205 |
| 5,328,095 | 7/1994 | Wickenhaver | 239/113 |
| 5,485,857 | 1/1996 | Amundsen | 134/102.2 |
| 5,485,860 | 1/1996 | Robb et al. | 134/166 |
| 5,487,399 | 1/1996 | Hannah | 134/138 |
| 5,491,282 | 2/1996 | Engelking | 588/261 |
| 5,839,457 | 11/1998 | Rijken | 134/110 |

*Primary Examiner*—Frankie L. Stinson
*Assistant Examiner*—Mialeeka C. Williams-Bibbs
*Attorney, Agent, or Firm*—John D. Gugliotta

[57] ABSTRACT

A draw-tube solvent retaining and draining cover is disclosed, comprised of a main body, of a generally linearly elongated, cylindrical, hollow configuration. The main body is of sufficient length to allow a conventional pick-up tube to pass through the main body and into a paint can. Grooves to improve gripping are located on the exterior circumferential surface of the main body. The main body is comprised of an upper portion and a lower portion, which connect via mated threads on the bottom of the upper portion and the top of the lower portion. An upper cap is located on the top of the upper portion, releasable secured to the top portion of the main body via mated threads. The upper cap is releasably secured to the packing cylinder of the majority of airless sprayers via a universal attachment means. The upper cap has a pick-up tube hole and a return hose hole. O-rings are located between the various components. The sectional nature of the present invention permits upper portion to remain on the pick-up tube when the sprayer is used with a one gallon bucket of paint. A filling indicia reduces the likelihood of spillage. When being stored, the main body may be releasably secured to various portions of the frame on an airless sprayer via a main body attachment means. The present invention is constructed of a material selected from the group comprising aluminum and plastic.

8 Claims, 6 Drawing Sheets

DRAW-TUBE SOLVENT RETAINING AND DRAINING COVER

RELATED APPLICATIONS AND DISCLOSURES

The present invention was first disclosed in a Disclosure Document filed on May 12, 1998. There have been no previously filed, nor any co-pending applications anywhere in the world.

BACKGROUND OF THE INVENTION

1. Field of the Invention

The present invention relates generally to solvent storage means for paint sprayers, and, more particularly, to a draw-tube solvent retaining and draining cover.

2. Description of the Related Art

Modern house-painting technology has come a long way from brushes and rollers. Powered airless sprayers allow the paint to be applied in a consistent, uniform manner with a high degree of efficiency, producing professional quality results in a reduced amount of time.

These systems usually consist of a motor driven pump that is mounted on a frame such that they rest several feet above the ground. A pick-up tube extends down vertically beneath the pump toward the ground so that it can be inserted into an opened can of paint, allowing the paint to be drawn therefrom and delivered to the sprayer.

While this system is invaluable to painters who depend on them to allow them to keep up with their busy schedules, it does suffer from a drawback in that the pick-up tube requires frequent cleaning in order to prevent paint from drying therein, causing clogs and otherwise restricting flow. While cleaning of the pump and pick-up tube is essential for proper operation, it is many times unnecessary during the intervening time between job sites or between workdays where the same paint is being used.

Accordingly, there is a need for a means by which the pick-up tube on airless sprayers can be maintained between jobs that use the same paint without having to perform cleaning operations thereon.

In the related art, several devices disclose an attached paint solvent reservoir and recycler. These include U.S. Pat. No. 5,485,860 issued in the name of Robb et. al., U.S. Pat. No. 5,183,066 issued in the name of Hethcoat, U.S. Pat. No. 5,174,317 issued in the name of Robb et. al., U.S. Pat. No. 4,793,369 issued in the name of Robb et. al. and U.S. Pat. No. 2,786,000 issued in the name of Roach.

U.S. Pat. No. 5,025,818 issued in the name of Kaler, describes a paint cleaning apparatus that pumps solvent and cleans the inside and outside of a paint spraying outfit.

U.S. Pat. No. 5,485,857 issued in the name of Amundsen, discloses a hand-held transmission flushing system with cleaning solvent.

U.S. Pat. No. 5,328,095 issued in the name of Wickenhaver, discloses a paint nozzle cleaning apparatus utilizing forced air.

A search of the prior art did not disclose any patents that read directly on the claims of the instant invention. Consequently, a need has been felt for providing an apparatus and method which overcomes the problems cited above.

SUMMARY OF THE INVENTION

It is therefore an object of the present invention to provide an improved draw-tube solvent retaining and draining cover that provides the means whereby the pick-up tube on airless sprayers can be maintained between jobs that use the same paint without having to perform cleaning operations thereon.

Briefly described according to one embodiment of the present invention, a draw-tube solvent retaining and draining cover is disclosed, comprising a main body, of a generally linearly elongated, cylindrical, hollow configuration, of a diameter such that the main body slides over the pick-up tube on a conventional airless paint sprayer. The main body is of sufficient length to allow a conventional pick-up tube to pass through the main body and into a paint can, with the main body completely covering the entire exposed length of the pick-up tube.

Grooves are located on the exterior circumferential surface of the main body, running parallel to the elongated centerline of the main body, so as to facilitate grasping of the present invention with hands.

The main body is comprised of an upper portion and a lower portion, which connect via mated threads on the bottom of the upper portion and the top of the lower portion. An O-ring is used between the lower portion and upper portion to provide a water tight seal.

An upper cap is located on the top of the upper portion, releasable secured to the top portion of the main body via mated threads. An O-ring is used between the upper cap and upper portion to provide a water tight seal.

The upper cap is releasably secured to the packing cylinder of the majority of airless sprayers via a universal attachment means, thus allowing the present invention to be retrofitted onto existing sprayers.

The upper cap has a pick-up tube hole located in the radial center, designed to permit a pick-up tube to tightly, slidably engage therethrough.

A return hose hole is also located on the upper cap, designed to permit a return hose to snugly, slidably engage therethrough.

The sectional nature of the present invention permits upper portion to remain on the pick-up tube when the sprayer is used with a one gallon bucket of paint. The lower portion of the main body has an elongated centerline sufficient to permit the present invention to easily clear a conventional one gallon bucket when the bottom portion is removed, or at least 9.5 inches. For use of the present invention with five gallon buckets, both the upper portion and lower portion may be removed as necessary when the sprayer is in use.

A filling indicia is located on the inside of the bottom portion, said filling indicia designed to reduce overfilling of the bottom portion with liquid, such as water, solvent, and the like.

When not in use, the main body may be releasably secured to various portions of the frame on an airless sprayer via a main body attachment means.

In the preferred embodiment of the present invention, the main body attachment means consists of a band clamp pivotally attached to a storage cap via a pivoting means. The storage cap releasably secures to the upper portion of the main body. A bolt and wing nut are positioned on the band clamp opposite the pivoting means, and are designed to clamp the band clamp down on the frame. As such, the pivoting means permits the main body to be pivoted relative to the frame of the sprayer and secured in a variety of angles relative to the frame of the sprayer.

The present invention is constructed of a material selected from the group comprising aluminum and plastic.

In an alternate embodiment of the present invention, the bottom of the lower portion of the main body has a removable lower cap that allows the fluid to be drained prior to removing the present invention in order to prevent accidental spills.

It is another object of the present invention to provide a device that prevents paint from drying or clogging a pick-up tube.

It is another object of the present invention to provide a device that is easy to install.

It is another object of the present invention to provide a device that eliminates unnecessary cleaning of the pick-up tube, thus saving time.

It is another object of the present invention to provide a device that extends the life of packings, since the packings do not dry out.

It is another object of the present invention to provide a device that is easily drained.

It is another object of the present invention to provide a device that easily clears a standard one gallon can when the bottom portion of the present invention is removed.

It is another object of the present invention to provide a device that easily attaches to the frame of a conventional sprayer, being able to be positioned at a variety of angles, thus providing a place for the present invention to be stored when not in use and the sprayer is being used and reducing spills.

It is another object of the present invention to provide a device that has a filling indicia on the bottom portion to prevent overfilling of the bottom portion.

It is another object of the present invention to provide a device that is lightweight, strong and durable.

Other objects of the present invention include providing a device that is corrosion resistant, is easily manufactured, can be used with a wide range of sprayers from hardware store types to major construction sprayers, is convenient to use with a one-gallon can or a five-gallon bucket, and has a cost-effective design.

DESCRIPTIVE KEY

| | | | |
|---|---|---|---|
| 10 | draw-tube solvent retaining and draining cover | 130 | return hose hole |
| 15 | sprayer | 135 | return hose |
| 20 | main body | 150 | filling indicia |
| 21 | exterior surface | 160 | liquid |
| 30 | pick-up tube | 170 | frame |
| 40 | tactile facilitators | 180 | main body attachment means |
| 50 | upper portion | 190 | band clamp |
| 60 | lower portion | 195 | storage cap |
| 70 | mated threads | 200 | pivoting means |
| 80 | O-ring | 210 | bolt |
| 90 | upper cap | 220 | wing nut |
| 100 | packing cylinder | 230 | lower cap |
| 110 | universal attachment means | | |
| 120 | pick-up tube hole | | |

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the FIGS. 1 through 5*c*.

1. Detailed Description of the Figures

Figure 1:
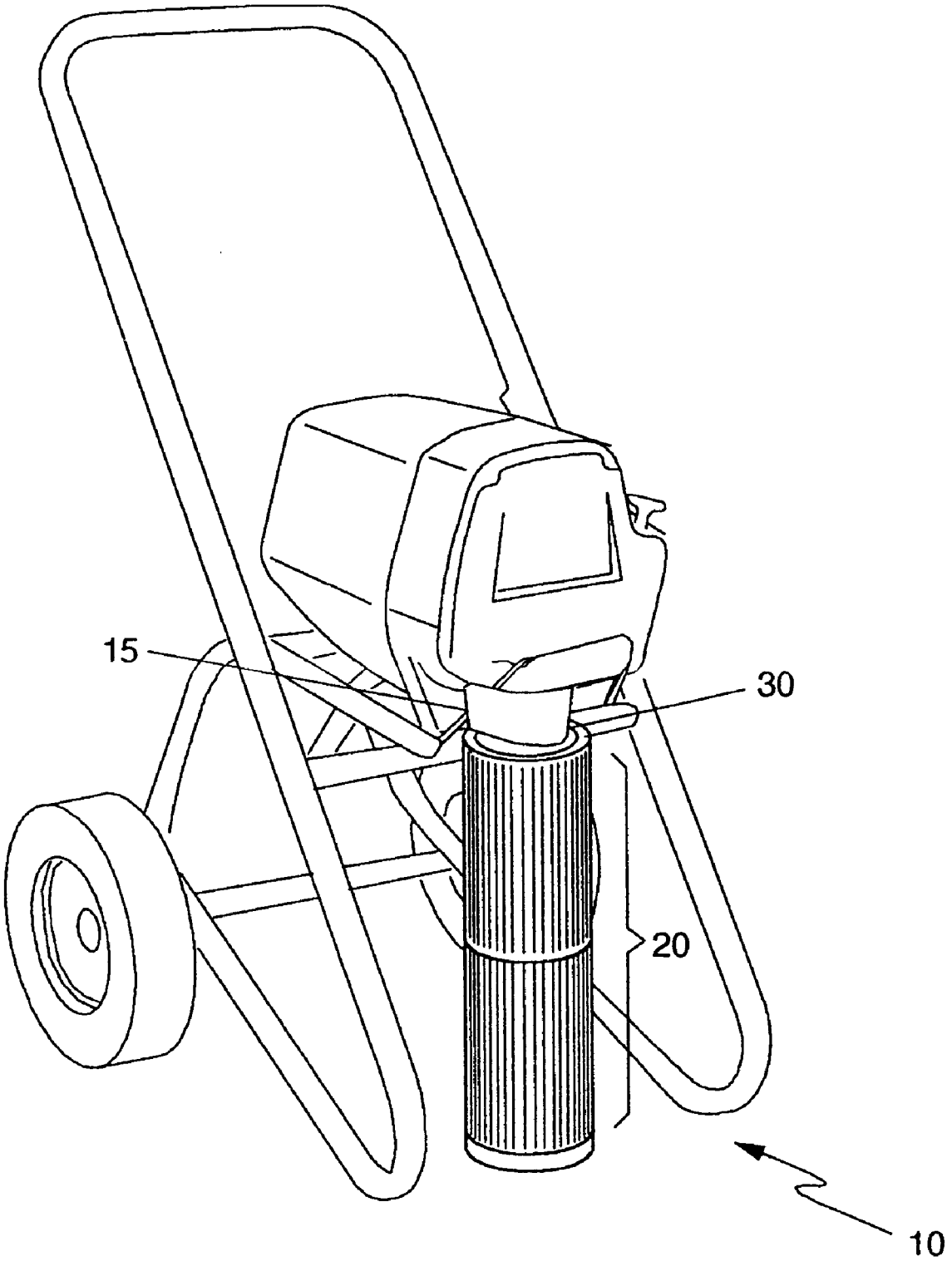
FIG. 1 is a perspective view of the preferred embodiment of draw-tube solvent retaining and draining cover 10, in use with a paint sprayer.

Referring now to FIG. 1, a draw-tube solvent retaining and draining cover 10 is shown, for use with a conventional airless sprayer 15, according to the present invention, comprising a main body 20, of a generally linearly elongated, cylindrical, hollow configuration, of a diameter such that the main body 20 slides over the pick-up tube 30 on a conventional airless paint sprayer 15.

Figure 2:
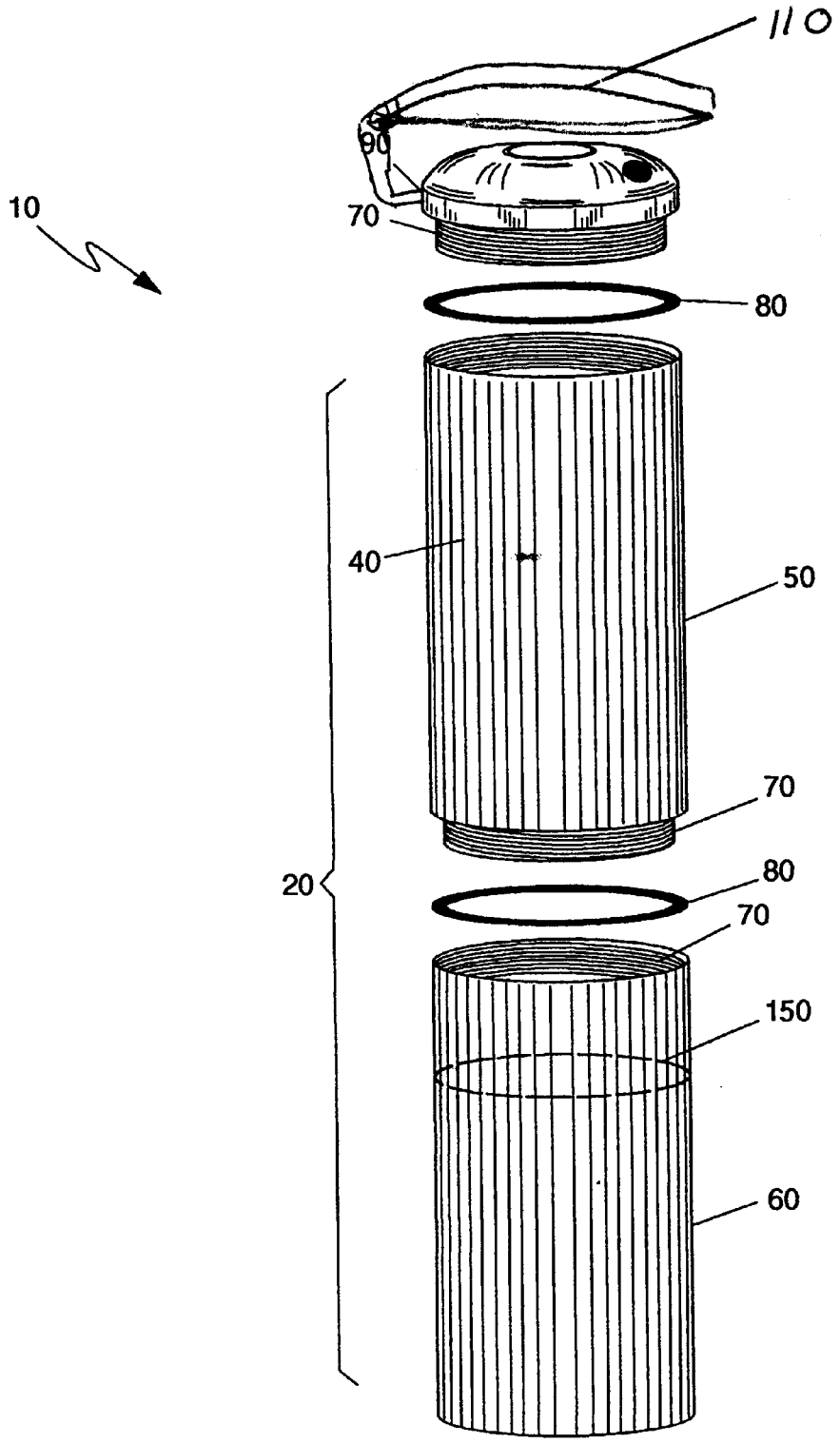
FIG. 2 is an exploded view thereof.

Referring now to FIG. 2, tactile facilitators 40, such as grooves or the like, so as to facilitate grasping, twisting and tightening without the use of conventional nor specialized tools. These tactile facilitators 40 are depicted herein as grooves, located on the exterior circumferential surface of the main body 20, running parallel to the elongated centerline of the main body 20.

The main body 20 is comprised of an upper portion 50 and a lower portion 60. A conventional connections means 70 is used to accomplish linear attachment of the upper portion to the lower portion. For example, mated threads 70 are located on the bottom of the upper portion 50 and the top of the lower portion 60. An O-ring 80 is used between the lower portion 60 and upper portion 50 to provide a water tight seal.

An upper cap 90 is located on the top of the upper portion 50, releasable secured to the top portion of the main body 20. An O-ring 80 is used between the upper cap 90 and upper portion 50 to provide a water tight seal.

Figure 3:
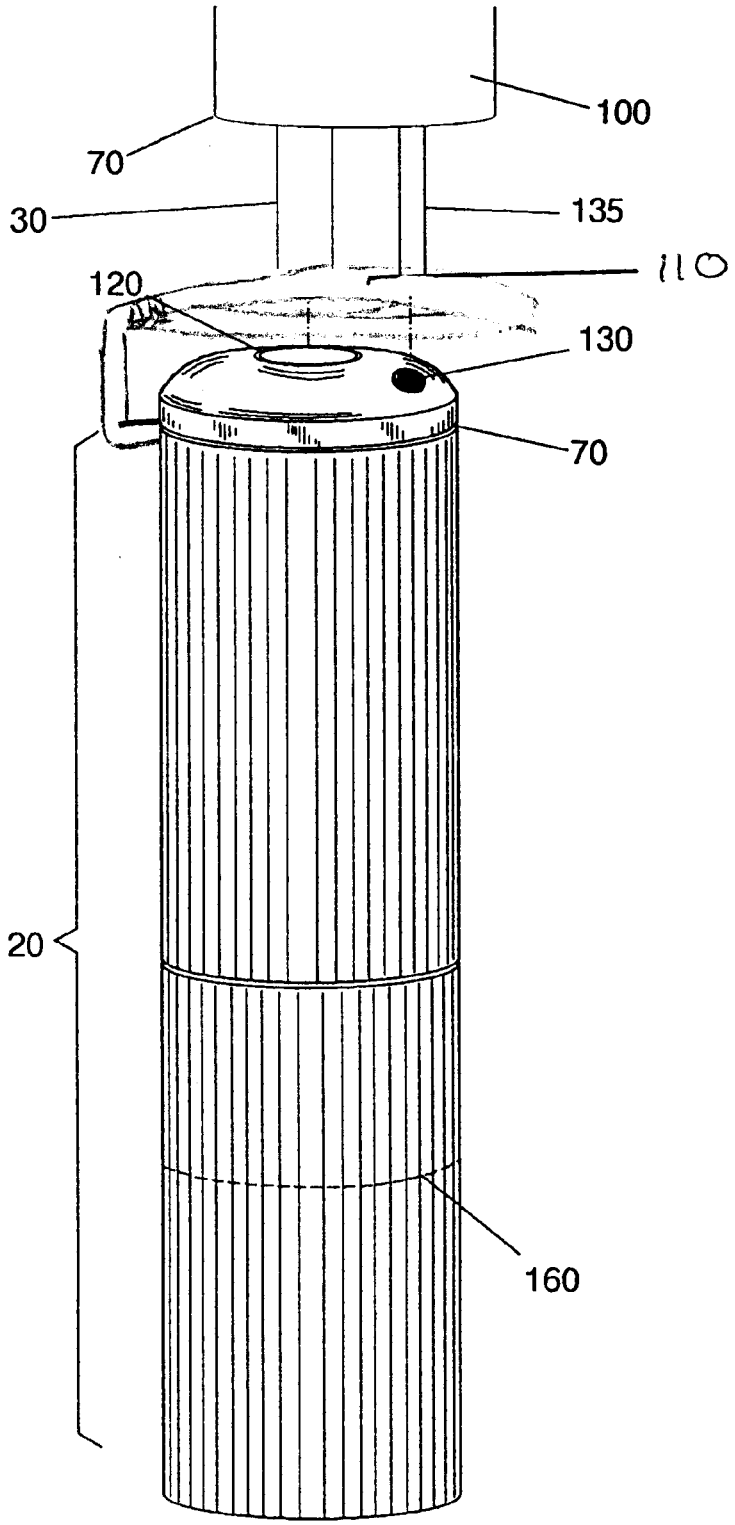
FIG. 3 is an side view thereof, shown in-use with a conventional sprayer.

Referring now to FIG. 3, the main body 20 is of sufficient length to allow a conventional pick-up tube 30 to pass through the main body 20 and into a paint can, with the main body 20 completely covering the entire exposed length of the pick-up tube 30.

Figure 4:
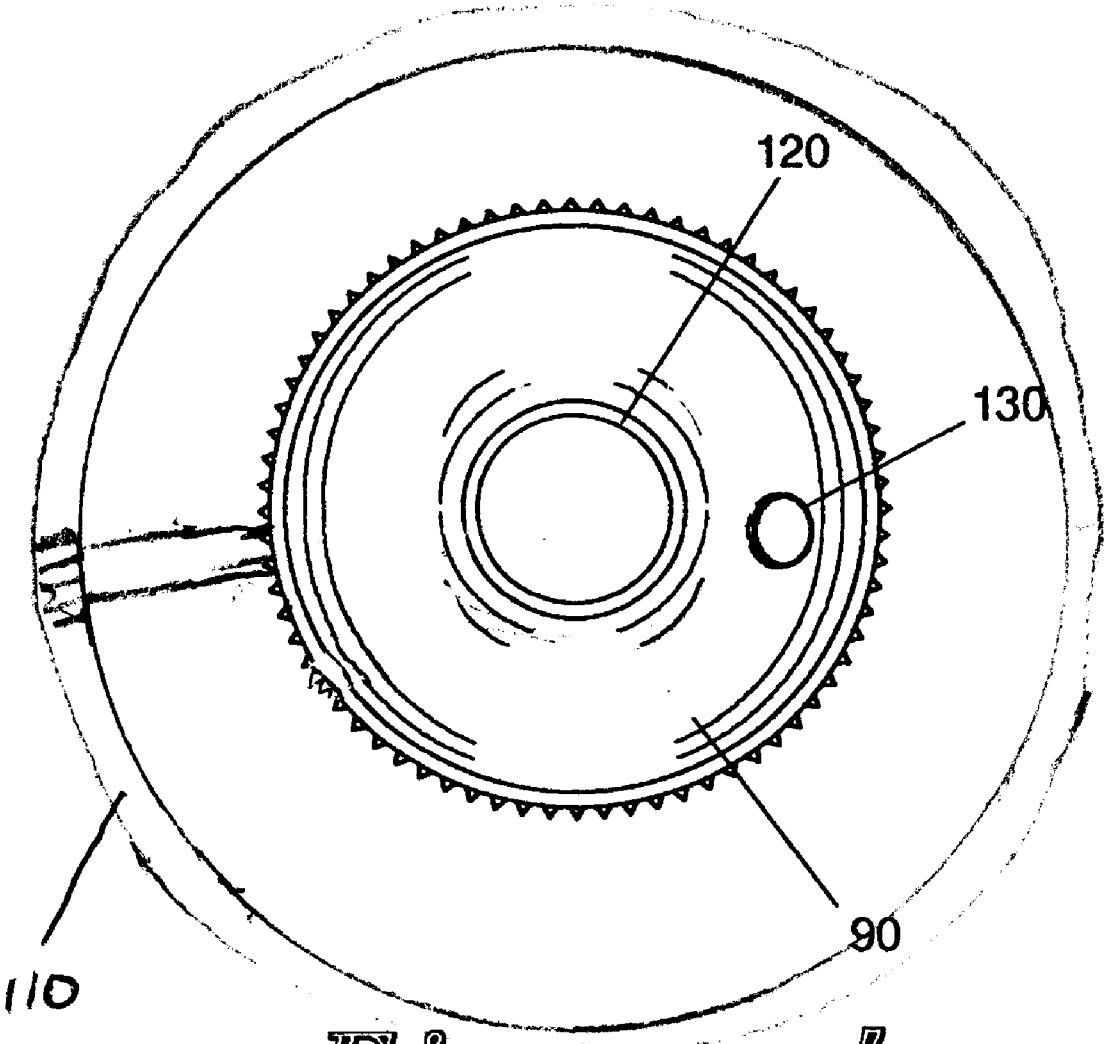
FIG. 4 is a top view of the preferred embodiment of the present invention.

Referring now to FIGS. 3 and 4, the upper cap 90 is releasably secured to the packing cylinder 100 of the majority of airless sprayers 15 via a universal attachment means 110, thus allowing the present invention to be retrofitted onto existing sprayers 15. The universal attachment means 1 10 is capable of being adjusted to create a friction fit with the external circumferential surface of a packing cylinder 100 of varying cross sectional diameters.

Further, the upper cap 90 has a pick-up tube hole 120 located in the radial center, designed to permit a pick-up tube 30 to tightly, slidably engage therethrough. A return hose hole 130 is also located on the upper cap 90, designed to permit a return hose 135 to snugly, slidably engage therethrough.

The sectional nature of the present invention permits upper portion 50 to remain on the pick-up tube 30 when the sprayer 15 is used with a one gallon bucket of paint. The lower portion 60 of the main body 20 has an elongated centerline sufficient to permit the present invention to easily clear a conventional one gallon bucket when the bottom portion is removed, or at least 9.5 inches. For use of the present invention with five gallon buckets, both the upper portion 50 and lower portion 60 may be removed as necessary when the sprayer 15 is in use.

Referring now to FIG. 2, a filling indicia 150 is located on the inside of the bottom portion, to reduce overfilling of the bottom portion with liquid 160, such as water, solvent, and the like.

Figure 5A:
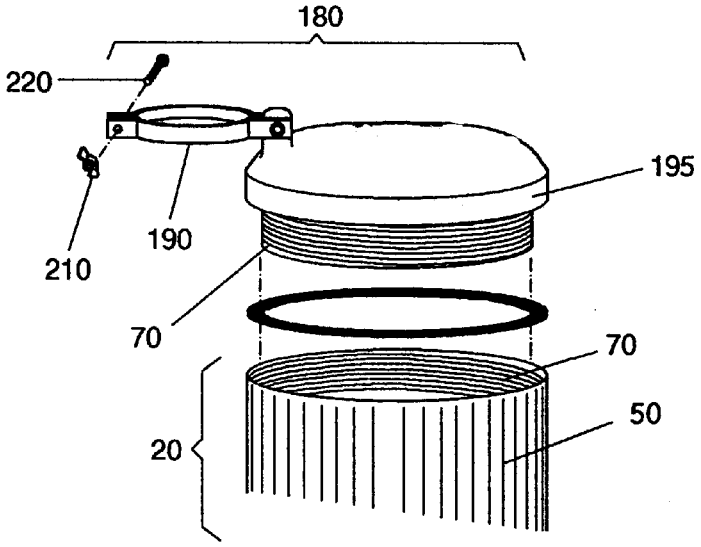
FIG. 5*a* is an exploded view of the main body attachment means in use with the main body.
Figure 5B:
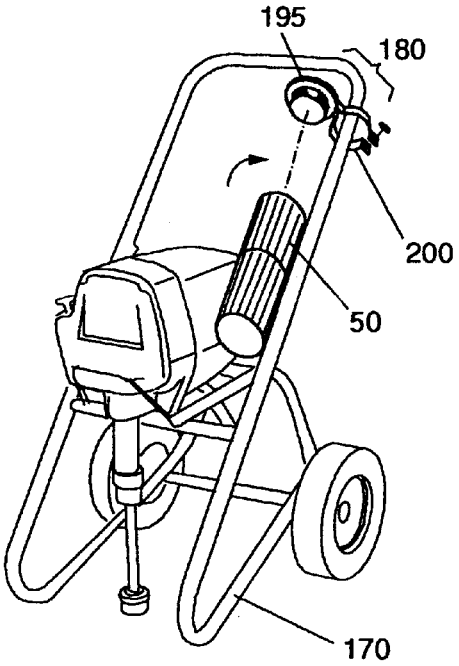
FIG. 5*b* is a perspective view thereof shown with a sprayer.
Figure 5C:
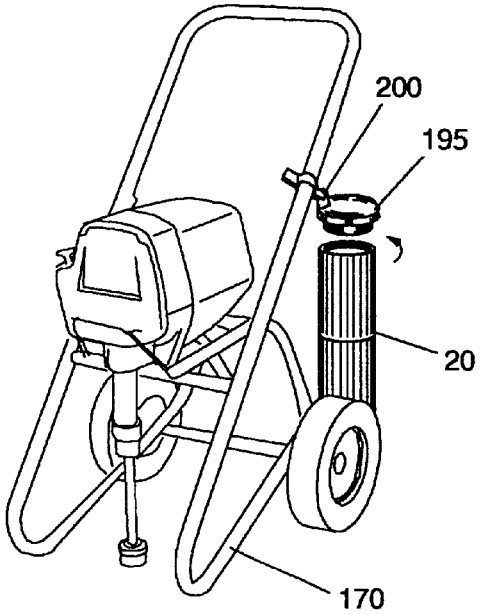
FIG. 5*c* is another in use view thereof with the present invention in the vertical position.

Referring now to FIGS. 5*a*–5*c*, when not connected to the packing cylinder 100 of the sprayer 15, the main body 20 may be releasably secured to various portions of the frame 170 on an airless sprayer 15 via a main body attachment means 180.

Referring now to FIG. 5*a*, in the preferred embodiment of the present invention, the main body attachment means 180 consists of a band clamp 190 pivotally attached to a storage cap 195.

Referring now to FIGS. 5*a* and 5*b*, the storage cap 195 is threaded to mate with the threads on top of the upper portion 50 of the main body 20. A bolt 210 and wing nut 220 are positioned on the band clamp 190 opposite the pivoting means 200, and are designed to clamp the band clamp 190 down on the frame 170.

Referring now to FIG. 5*c*, as such, the pivoting means 200 permits the main body 20 to be pivoted relative to the frame 170 of the sprayer 15 and secured in a variety of angles relative to the frame 170 of the sprayer 15.

Figure 6:
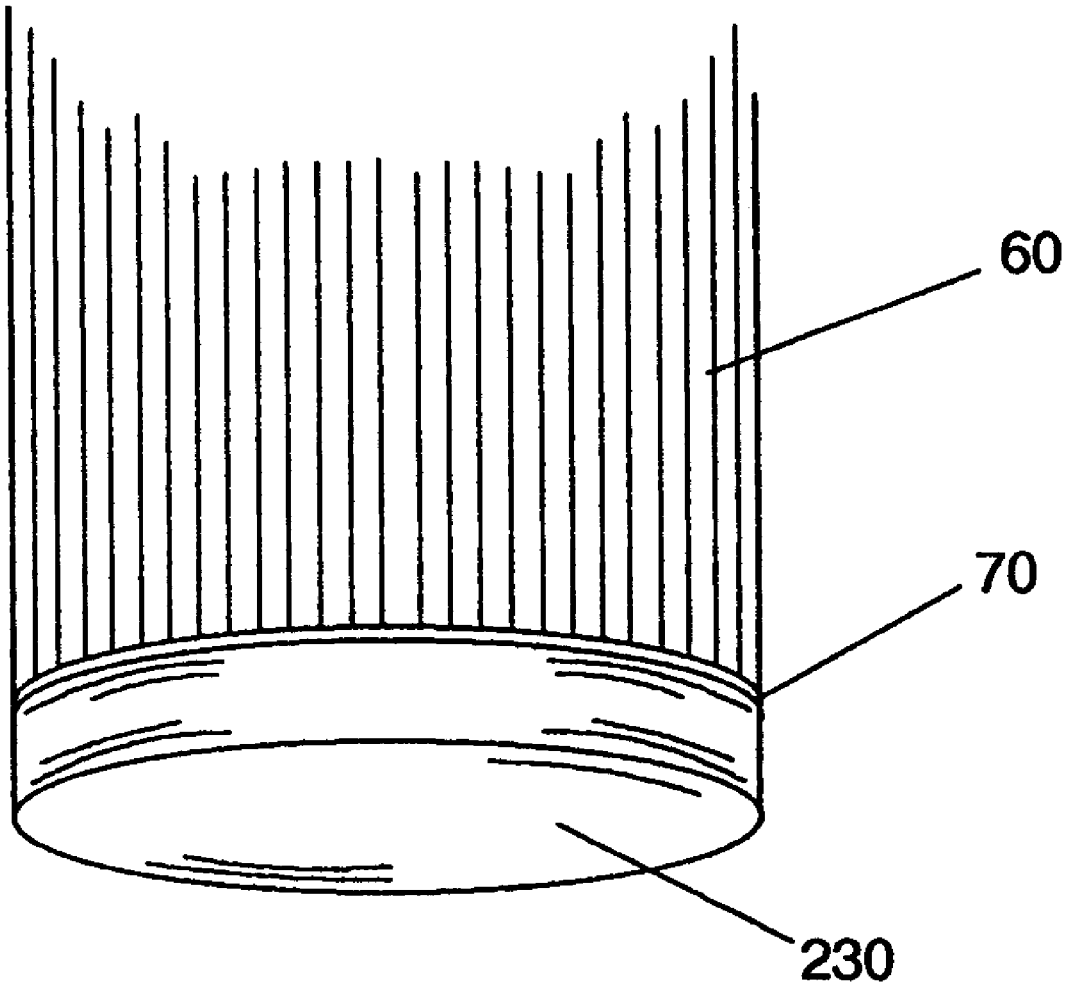
FIG. 6 is a bottom perspective view of an alternate embodiment of the present invention.

Referring now to FIG. 6, in an alternate embodiment of the present invention, the bottom of the lower portion 60 of the main body 20 has a removable lower cap 230 that allows the fluid to be drained prior to removing the present invention in order to prevent accidental spills. Mating threads provide the removable nature of the lower cap 230.

It is envisioned that other styles and configurations of the present invention can be easily incorporated into the teachings of the present invention, and only two particular configurations shall be shown and described for purposes of clarity and disclosure and not by way of limitation of scope.

2. Operation of the Preferred Embodiment

Referring now to FIGS. 3, 5*a*–5*c*, to use the present invention, the user lays the sprayer 15 on its back and removes the screen from the end of the sprayer 15. By sliding the upper cap 90 onto over the pick-up tube 30 and moving it to the top of the pick-up tube 30, the return hose 135 is inserted through the return hose hole 130 on the upper cap 90. By tightening the upper cap 90 to the upper packing cylinder 100 and replacing the screen; the present invention is now ready for use when the sprayer 15 in the upright position. When ready to store the airless sprayer, place the sprayer 15 on its side, and place the upper portion 50 over the pick-up tube 30 and screw onto the upper cap 90, making sure an O-ring 80 is in between. Fill the bottom portion to the filling indicia 150 with the appropriate fluid, hold the present invention vertically and raise the sprayer 15. Then, place the lower portion 60 over the pick-up tube 30 and screw the lower portion 60 onto the upper portion 50, making sure an O-ring 80 is in between. Store sprayer 15 till needed. When the present invention is not needed, attach it to the frame 170 of the airless sprayer 15 by tightening the main body attachment means 180.

The foregoing description is included to illustrate the operation of the preferred embodiment and is not meant to limit the scope of the invention. The scope of the invention is to be limited only by the following claims.

What is claimed is:

1. A draw-tube solvent retaining and draining cover, said cover comprising:

a main body, of a generally linearly elongated, cylindrical, hollow configuration, of a diameter such that said main body slides over the pick-up tube on a conventional airless paint sprayer; said main body comprised of an upper portion and a lower portion, and forming an exterior circumferential surface;

an upper cap, located on the top of and releasably secured to said upper portion;

mated threads, said mated threads located on the bottom of said upper portion and the top of said lower portion, said mated threads designed to facilitate releasable securement of said upper portion and said lower portion;

a universal attachment means, said universal attachment means located on top of said upper cap, and designed facilitate releasable securement of said upper cap to the packing cylinder of the majority of airless sprayers;

a main body attachment means, said main body attachment means designed to releasably secure said main body to various portions of the frame of said sprayer when said main body is not connected to said packing cylinder of said sprayer;

O-rings, said O-rings positioned between said lower portion, said upper portion, and said upper cap, said O-rings designed to provide an air tight seal.

2. The cover described in claim 1, wherein said upper cap further comprises:

a pick-up tube hole, located in the radial center of and formed by said upper cap, said pick-up tube hole designed to permit a pick-up tube to tightly, slidably engage therethrough; and a return hose hole, located on and formed by said upper cap, said return hose hole designed to permit a return hose to snugly, slidably engage therethrough.

3. The cover described in claim 1, wherein said main body attachment means further comprises:

a storage cap, said storage cap threaded to mate with threads on top of said upper portion of said main body;

a band clamp, said band clamp pivotally attached to a storage cap via a pivoting means;

a fastener, positioned on said band clamp opposite said pivoting means, said fastener designed to clamp said band clamp down on said frame.

4. The cover described in claim 1, wherein said pivoting means permits said main body to be pivoted relative to said frame of said sprayer and secured in a variety of angles relative to said frame of said sprayer.

5. The cover described in claim 1, wherein the bottom of said lower portion of said main body has a removable lower cap that allows the fluid to be drained prior to removing said present invention in order to prevent accidental spills.

6. The cover described in claim 1, wherein a filling indicia, located on the inside of said bottom portion, said filling indicia designed to reduce overfilling of said bottom portion with liquid, such as water, solvent, and the like.

7. The cover described in claim 1, wherein said main body is of sufficient length to allow a conventional pick-up tube to pass through said main body and into a paint can, with said main body completely covering the entire exposed length of said pick-up tube.

8. The cover described in claim 1, wherein tactile facilitators are located on the exterior circumferential surface of said main body, said tactile facilitators running parallel to the elongated centerline of said main body, so as to facilitate grasping of the present invention with hands.

* * * * *